US009249482B2

(12) United States Patent
Jakobi et al.

(10) Patent No.: US 9,249,482 B2
(45) Date of Patent: Feb. 2, 2016

(54) NICKEL-CHROMIUM-ALLOY

(75) Inventors: Dietlinde Jakobi, Köln (DE); Peter Karduck, Würselen (DE); Alexander Freiherr Von Richthoffen, Aachen (DE)

(73) Assignee: SCHMIDT + CLEMENS GMBH + CO. KG, Lindlar (DE)

( * ) Notice: Subject to any disclaimer, the term of this patent is extended or adjusted under 35 U.S.C. 154(b) by 631 days.

(21) Appl. No.: 13/124,016

(22) PCT Filed: Oct. 13, 2009

(86) PCT No.: PCT/EP2009/007345
§ 371 (c)(1),
(2), (4) Date: Jul. 5, 2011

(87) PCT Pub. No.: WO2010/043375
PCT Pub. Date: Apr. 22, 2010

(65) Prior Publication Data

US 2011/0272070 A1 Nov. 10, 2011

(30) Foreign Application Priority Data

Oct. 13, 2008 (DE) ..... 10 2008 051 014

(51) Int. Cl.
*C22C 19/05* (2006.01)
*C22C 30/00* (2006.01)

(52) U.S. Cl.
CPC ..... *C22C 19/05* (2013.01); *C22C 19/053* (2013.01); *C22C 19/055* (2013.01); *C22C 30/00* (2013.01)

(58) Field of Classification Search
CPC combination set(s) only.
See application file for complete search history.

(56) References Cited

U.S. PATENT DOCUMENTS

| | | | | |
|---|---|---|---|---|
| 2,564,498 | A * | 8/1951 | Nisbet | 75/10.14 |
| 3,826,689 | A | 7/1974 | Ohta et al. | |
| 4,248,629 | A | 2/1981 | Pons et al. | |
| 5,306,358 | A | 4/1994 | Lai et al. | |
| 7,859,177 | B2 * | 12/2010 | Yoshimoto et al. | 313/141 |
| 2007/0159046 | A1 | 7/2007 | Yoshimoto et al. | |

FOREIGN PATENT DOCUMENTS

| | | | | |
|---|---|---|---|---|
| CA | 2 513 830 | | 12/2010 | |
| CN | 1742106 | A | 3/2006 | |
| DE | 10302989 | B4 | 3/2005 | |
| EP | 0 322 156 | B1 | 4/1993 | |
| EP | 1 065 290 | B1 | 8/2003 | |
| EP | 1 717 330 | A1 | 11/2006 | |
| FR | 2429843 | | 10/1983 | |
| JP | 57-131348 | * | 2/1981 | C22C 38/52 |
| JP | 63053234 | | 3/1988 | |
| JP | 2263895 | | 10/1990 | |
| JP | 2001040443 | | 2/2001 | |
| JP | 2003221634 | | 8/2003 | |
| JP | 2004 052036 | | 2/2004 | |
| JP | 2004197149 | A | 7/2004 | |
| WO | PCT/JP2005/000892 | | 8/2005 | |

OTHER PUBLICATIONS

English Abstract and English Machine Translation of Takahashi et al. (JP 2004-052036) (Feb. 19, 2004).*
Huang, Xuebing, Yun Zhang, and Zhuangqi Hu. "Effect of small amounts of nitrogen on properties of a Ni-based superalloy." Metallurgical and Materials Transactions A 30.7 (1999): 1755-1761.*
ASM International, Materials Park, Ohio, ASM Handbook vol. 2: Properties and Selection: Nonferrous Alloys and Special Purpose Materials Preparation and Characterization of Pure Metals, pp. 1093-1097, Oct. 1990.*
English Abstract of JP 57-131348 (Feb. 1981).*
H.J. Grabke et al: "Carburization and Oxidation", in: Materials Science and Engineering, vol. 87, 1987, pp. 23-33.
Briant, C. L. "Impurities in Engineering Materials : Impact, Reliability, and Control." New York: Marcel Dekker, 1999.
Canadian Office Action issued Mar. 10, 2015, in counterpart Canadian Patent Application No. 2,740,160.

* cited by examiner

*Primary Examiner* — Jessee Roe
(74) *Attorney, Agent, or Firm* — Howard IP Law Group, PC

(57) ABSTRACT

A nickel chromium alloy with 0.4 to 0.6% carbon, 28 to 33% chromium, 15 to 25% iron, 2 to 6% aluminum, up to 2% silicon, up to 2% manganese, up to 1.5% niobium, up to 1.5% tantalum, up to 1.0% tungsten, up to 1.0% titanium, up to 1.0% zirconium, up to 0.5% yttrium, up to 0.1% nitrogen, remainder nickel, has a high oxidation and carburization stability, long-term rupture strength and creep resistance. This alloy is particularly suited as a material for components of petrochemical plants and for parts, for example tube coils of cracker and reformer furnaces, pre-heaters, and reformer tubes, as well as for use for parts of iron ore direct reduction plants.

5 Claims, 9 Drawing Sheets

NICKEL-CHROMIUM-ALLOY

CROSS-REFERENCES TO RELATED APPLICATIONS

This application is the U.S. National Stage of International Application No. PCT/EP2009/007345, filed Oct. 13, 2009, which designated the United States and has been published as International Publication No. WO 2010/043375 and which claims the priority of German Patent Application, Serial No. 10 2008 051 014.9, filed Oct. 13, 2008, pursuant to 35 U.S.C. 119(a)-(d).

BACKGROUND OF THE INVENTION

For high-temperature processes, the petrochemical industry requires materials which are temperature-resistant as well as corrosion-resistance and able to withstand, on one hand, the hot product gases and, on the other hand, also the hot combustion gases, for example, from steam crackers. Their tube coils are exposed on the outside to the oxidizing nitrogen-containing combustion gases having temperatures of 1100° C. and above, as well as in the interior to temperatures reaching approximately 900° C. and potentially also high-pressure of a carburizing and oxidizing atmosphere.

As a result, the nitrogen content of the tube material increases starting from the exterior tube surface and a scale layer is created in contact with the hot combustion gases.

The carburizing hydrocarbon atmosphere inside the tube carries the risk that carbon diffuses therefrom into the tube material, causing the carbides in the material to increase, forming from the existing carbide $M_{23}C_9$ with increasing carburization the carbon-rich carbide $M_7C_6$. Internal stress results from the volume increase of the carbides caused by the formation and conversion of carbide, and the strength and the ductility of the tube material are also reduced. In addition, a firmly adhering coke layer having a thickness of several millimeters is produced on the interior surface. Cyclic temperature stresses, for example caused by a shutdown of the plant, also cause the tubes to shrink onto the coke layer due to the different thermal expansion coefficients of the metallic tube and the coke layer. This causes large stresses in the tube which in turn cause cracks in the interior tube surface. An increasing amount of hydrocarbons can then enter the tube material through these cracks.

The U.S. Pat. No. 5,306,358 discloses a nickel chromium iron alloy which is weldable with the WIG process and has up to 0.5% carbon, 8 to 22% chromium, up to 36% iron, up to 8% manganese, silicon and niobium, up to 6% aluminum, up to 1% titanium, up to 0.3% zirconium, up to 40% cobalt, up to 20% molybdenum and tungsten as well as up to 0.1% yttrium, with the remainder being nickel.

The German patent 103 02 989 also describes a nickel chromium cast alloy suitable for tube coils of cracker and reformer furnaces with up to 0.8% carbon, 15 to 40% chromium, 0.5 to 13% iron, 1.5 to 7% aluminum, up to 0.2% silicon, up to 0.2% manganese, 0.1 to 2.5% niobium, up to 11% tungsten and molybdenum, up to 1.5% titanium, 0.1 to 0.4% zirconium, and 0.01 to 0.1% yttrium, with the remainder being nickel. This alloy has proven itself especially for the use as material for tubes; however, users still demand tube material with a prolonged life cycle.

The invention is therefore directed to a nickel chromium alloy with improved stability under conditions occurring, for example, during cracking and reforming of hydrocarbons.

As set forth throughout the disclosure, references to elements comprising a percentage (%) of an alloy composition should be understood to mean a weight percentage.

SUMMARY OF THE INVENTION

This object is attained with a nickel chromium alloy with 0.4 to 0.6% carbon, 28 to 33% chromium, 15 to 25% iron, 2 to 6% aluminum, up to 2% of each of silicon and manganese, up to 1.5% of each of niobium and tantalum, up to 1.0% of each of tungsten, titanium and zirconium, up to %0.5% of each of yttrium and cerium, up to 0.5% molybdenum and up to 0.1% nitrogen, with the remainder—including melt-induced contaminants—being nickel.

Preferably, this alloy includes—severally or in combination—17 to 22% iron, 3 to 4.5% aluminum, 0.01 to 1% silicon, up to 0.5% manganese, 0.5 to 1.0% niobium, up to 0.5 tantalum, up to 0.6% tungsten, 0.001 to 0.5% titanium, up to 0.3% zirconium, up to 0.3% yttrium, up to 0.3% cerium, 0.01 to 0.5% molybdenum and 0.001 to 0.1% nitrogen.

The alloy according to the invention is particularly distinguished by its comparatively high contents of chromium and nickel and by a required carbon content in a comparatively narrow range.

Of the optional alloy components, silicon improves the oxidation and carburization stability. Manganese has also a positive effect on the oxidation stability as well as additionally on the weldability, deoxidizes the melt and stably bonds the sulfur.

Niobium improves the long-term rupture strength, forms stable carbides and carbonitrides. Niobium additionally serves as hardener for solid solutions. Titanium and tantalum improve the long-term rupture strength. Finely distributed carbides and carbonitrides are already formed at low concentrations. At higher concentrations, titanium and tantalum function as solid solution hardeners.

Tungsten improves the long-term rupture strength. In particular at high temperatures, tungsten improves the strength by a way of a solid solution hardening, because the carbides are partially dissolved at higher temperatures.

Cobalt also improves the long-term rupture strength by way of solid solution hardening, zirconium by forming carbides, in particular in cooperation with titanium and tantalum.

Yttrium and cerium obviously improve not only the oxidation stability and, in particular, the adherence as well as the growth of the $Al_2O_3$ protective layer. In addition, yttrium and cerium improve already in small concentrations the creep resistance, because they stably bond the potentially still present free sulfur. Smaller concentrations of boron also improve the long-term rupture strength, prevent sulfur segregation and dalay aging by coarsening the $M_{23}C_9$ carbides.

Molybdenum also increases the long-term rupture strength, in particular at high temperatures via solid solution hardening. In particular, because the carbides are partially dissolved at high temperatures. Nitrogen improves the long-term rupture strength via carbon nitride formation, whereas already low concentrations of hafnium improve the oxidation stability through an improved adhesion of the protective layer, thereby positively affecting the long-term rupture strength.

Phosphorous, sulfur, zinc, lead, arsenic, bismuth, tin and tellurium are part of the impurities and should therefore have the smallest possible concentrations.

Under these conditions, the alloy is particularly suited as a casting material for parts of petrochemical plants, for example for manufacturing tube coils for cracker and reformer furnaces, reformer tubes, but also as material for iron ore direct reduction facilities as well as for similarly stressed components. These include furnace parts, radiant tubes for heating furnaces, rolls for annealing furnaces, components of continuous casting and strand casting machines, hoods and sleeves for annealing furnaces, components of large diesel engines, and molds for catalytic converter fillings.

Overall, the alloy is distinguished by a high oxidation and carburization stability as well as excellent long-term rupture strength and creep resistance. The interior surface of cracker and reformer tubes is characterized by a catalytically inert oxide layer containing aluminum which prevents the generation of catalytic coke filaments, so-called carbon nanotubes. The properties characterizing the material are retained also after the coke, which inevitably segregates during cracking on the interior wall of the tube, has been burned out several times.

Advantageously, the alloy can be used for producing tubes by centrifugal casting, if these are drilled out with a contact pressure of 10 to 40 MPa, for example 10 to 25 MPa. Drilling the tubes out causes the tube material to be cold-worked or strain-hardened in a zone near the surface having depths of, for example, 0.1 to 0.5 mm due to the contact pressure. When the tube is heated, the cold worked zone recrystallizes, producing a very fine-grain structure. The recrystallized structure improves the diffusion of the oxide-forming elements aluminum and chromium, promoting the creation of a continuous layer mostly made of aluminum oxide and having high density and stability.

The produced firmly adhering aluminum-containing oxide forms a continuous protective layer of the interior tube wall which is mostly free of catalytically active centers, for example of nickel or iron, and is still stable even after a prolonged cyclic thermal stress. Unlike other tube materials without such protective layer, this aluminum-containing oxide layer prevents oxygen from entering the base material and thus an interior oxidation of the tube material. In addition, the protective layer does not only suppress carburization of the tube material, but also corrosion due to impurities in the process gas. The protective layer is predominantly composed of $Al_2O_2$ and the mixed oxide $(Al, Cr)_2O_3$ and is largely inert against catalytic coking. It is depleted of elements which catalyze coking, such as iron and nickel.

Particularly advantageous for the formation of a durable protective oxide layer is heat treatment which can also be economically performed in situ; it is used to condition, for example, the interior surface of steam-cracker tubes after installation, when the respective furnace is heated to its operating temperature.

This conditioning can be performed in form of a heat-up with intermediate isothermal heat treatments in a furnace atmosphere which is adjusted during heat-up according to the invention, for example in a weakly oxidizing, water vapor-containing atmosphere with an oxygen partial pressure of at most $10^{-20}$, preferably at most $10^{-30}$ bar.

An inert gas atmosphere of 0.1 to 10 mole-% water vapor, 7 to 99.9 mole-% hydrogen or hydrocarbons, severally or in combination, and 0 to 88 mole-% noble gases are particularly favorable.

The atmosphere during conditioning is preferably comprised of an extremely weakly oxidizing mixture of water vapor, hydrogen, hydrocarbons and nobel gases with a mass ratio selected so that the oxygen partial pressure of the mixture at a temperature of 600° C. is smaller than $10^{-20}$, preferably smaller than $10^{-30}$ bar.

The initial heat-up of the tube interior after prior mechanical removal of a surface layer, i.e., the separate heat-up of the generated cold-worked surface zone, is preferably performed under a very weakly oxidizing inert gas in several phases, each at a speed of 10 to 100° C./h initially to 400 to 750° C., preferably approximately 550° C. on the interior tube surface. The heat-up phase is followed by a one-hour to fifty-hour hold in the described temperature range. The heat-up is performed in the presence of a water vapor atmosphere, as soon as the temperature has reached a value that prevents the generation of condensed water. After the hold, the tube is brought to the operating temperature, for example to 800 to 900° C., thus becoming operational.

However, the tube temperature slowly increases further during the cracking operation as a result of the deposition of pyrolytic coke, reaching approximately 1000° C. and even 1050° C. on the interior surface. At this temperature, the interior layer, which essentially consists of $Al_2O_2$ and to a small degree of $(Al, Cr)_2O_3$, is converted from a transitional oxide, such as γ-, δ- or θ-$Al_2O_2$ into stable α-aluminum oxide.

The tube, with its interior layer mechanically removed, has then reached its operating state in a multi-step, however preferably single process.

However, the process need not necessarily be performed in a single step, but may also start with a separate preliminary step. This preliminary step includes the initial heat-up after removal of the interior surface until a hold at 400 to 750° C. The tube pretreated in this way can then be further processed, for example at a different manufacturing site, starting from the cold state in the aforedescribed manner in situ, i.e., can be brought to the operating temperature after installation.

The aforementioned separate pretreatment, however, is not limited to tubes, but can also be used for partial or complete conditioning of surface zones of other workpieces, which are then further treated commensurate with their structure and use, either according to the invention or with a different process, however, with a defined initial state.

DETAILED DESCRIPTION OF PREFERRED EMBODIMENTS

Figure 1:
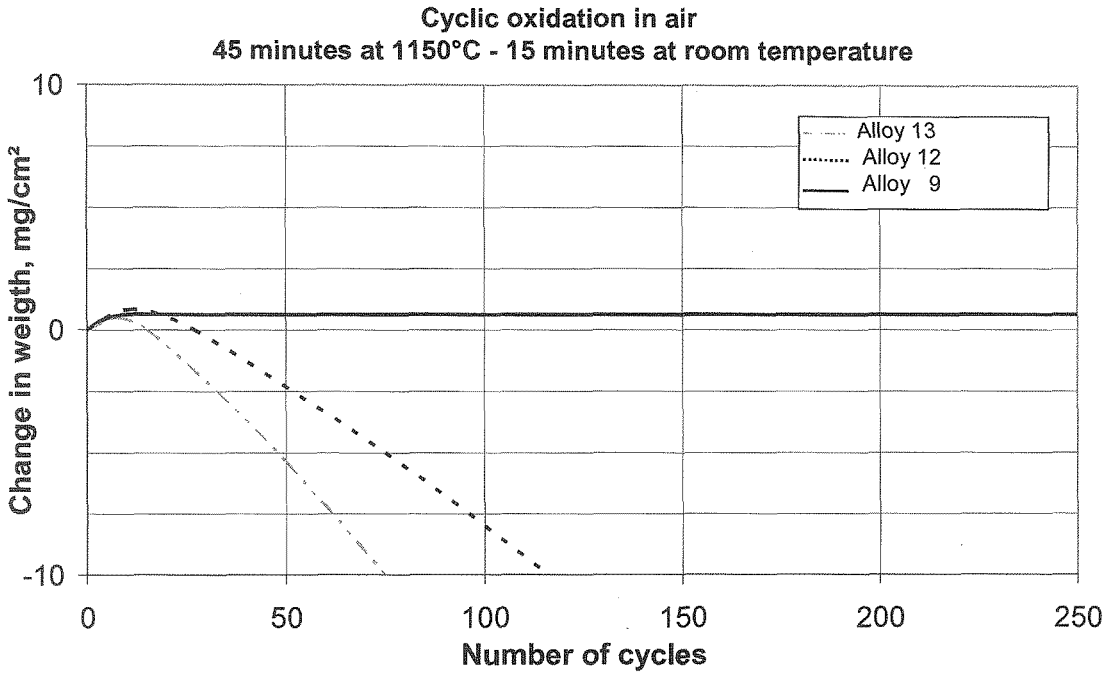
FIG. 1 shows weight change of various alloys as a function of the number of annealing cycles according to the present invention.

The invention will now be described with reference to five exemplary nickel alloys according to the invention and in comparison with ten conventional nickel alloys having the composition listed in Table I, which differ in particular from the nickel chromium iron alloy according to the invention with respect to their carbon content (alloys 5 and 6), chromium content (alloys 4, 13 and 14), aluminum content (alloys 12, 13), cobalt content (alloys 1, 2), and iron content (alloys 3, 12, 14, 15).

As shown in the diagram of FIG. 1, the alloy 9 according to the invention does not exhibit any interior oxidation even after more than 200 cycles of 45-minute annealing at 1150° C. in air, whereas the two comparison alloys 12 and 13 already undergo an increasing weight loss due to the catastrophic oxidation after only a few cycles.

Figure 2:
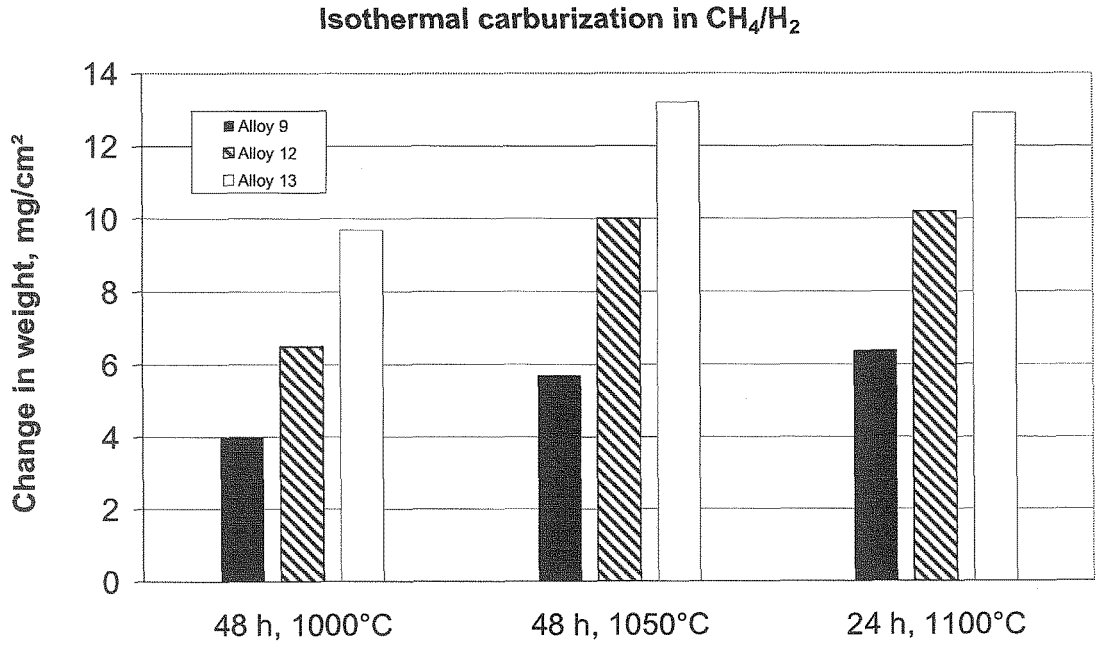
FIG. 2 shows weight gains of various alloys after carburizing treatment.

The alloy 9 is also distinguished by a high carburizing stability; because the alloy 9 has, due to its small weight gain, after all three carburizing treatments according to the diagram of FIG. 2 the smallest weight gain compared to the conventional alloys 12 and 13.

Figure 3A:
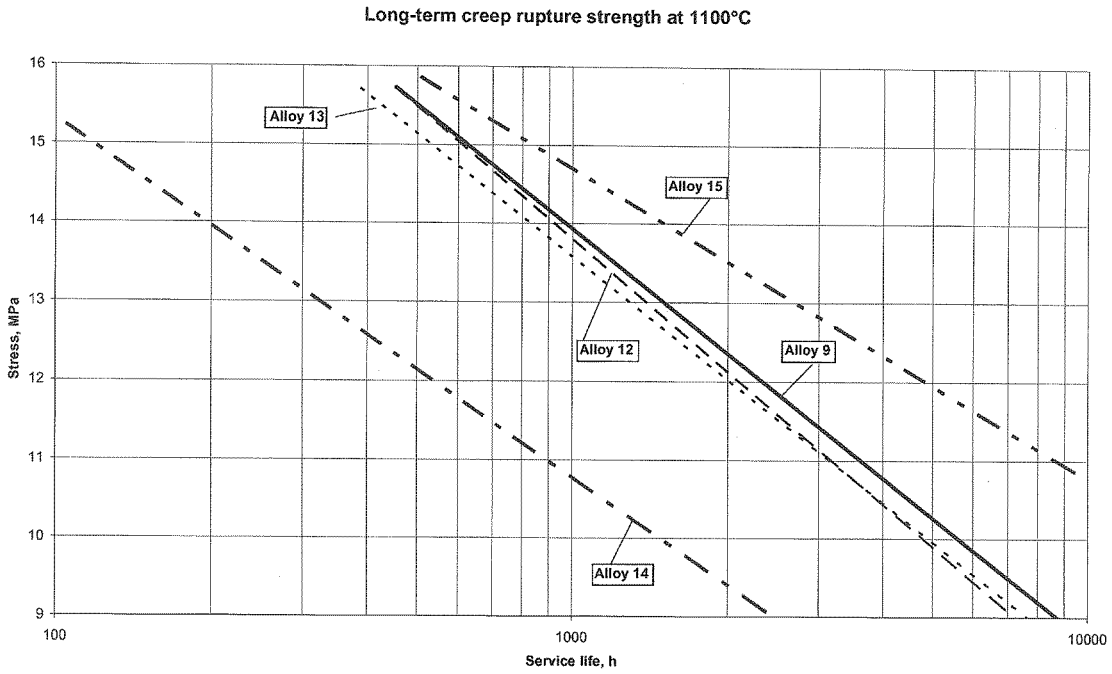
FIGS. 3*a* and 3*b* show long-term rupture strength of various alloys as a function of service life.
Figure 3B:
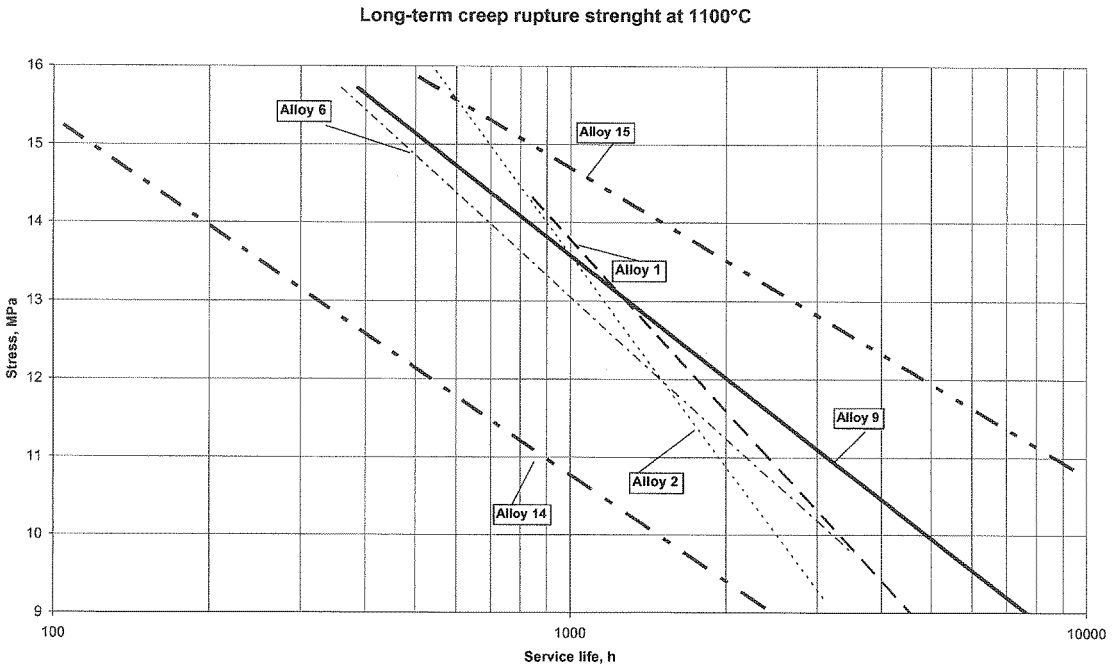

Moreover, the diagrams of FIGS. 3*a* and 3*b* show that the long-term rupture strength of the nickel alloy 11 according to the invention is in an important range still superior over that of the comparison alloys 12 and 13. The alloy 15, which is not part of the invention because its iron content is too low, is an exception, having significantly inferior oxidizing, carburizing and coking stability.

Figure 4:
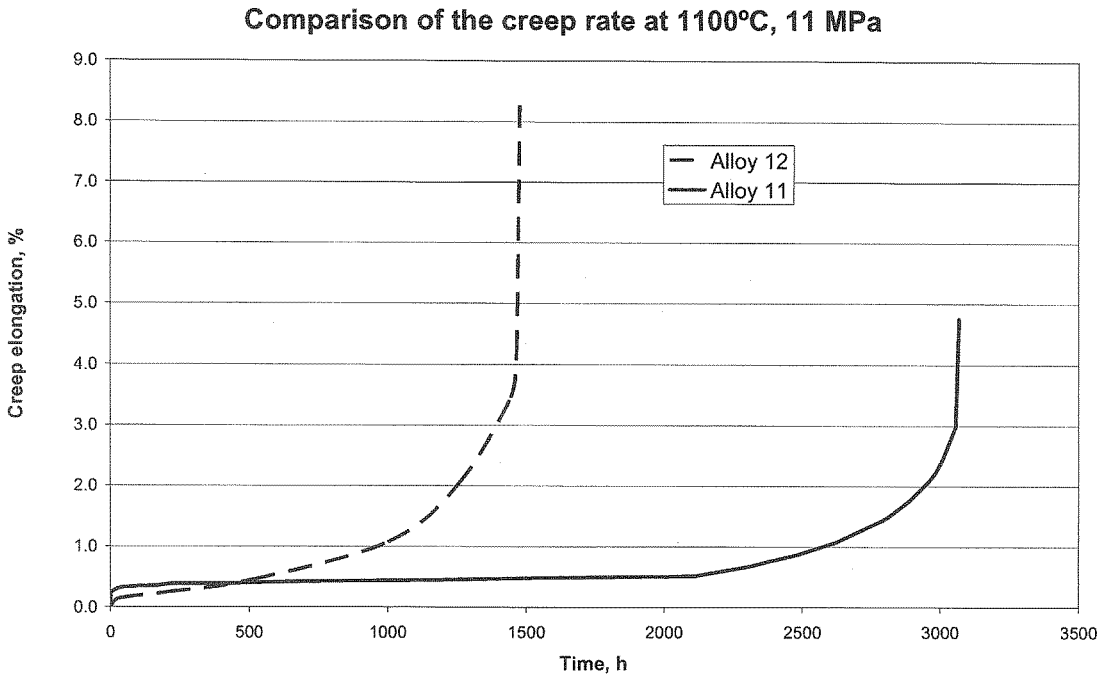
FIG. 4 shows a comparison of creep resistance of various alloys.

The diagram of FIG. 4 finally shows that the creep resistance of the alloy 11 is significantly better than that of the comparison alloy 12.

In addition, in a series of simulations of a cracking operation, several tube sections made of a nickel alloy according to the invention where inserted in a laboratory system to perform heat-up experiments under different gas atmospheres and different heat-up conditions, followed by a 30-minute cracking phase at a temperature of 900° C., in order to investigate and evaluate the initial phase of catalytic coking, or the tendency for catalytic coking.

The data and the results of these experiments with samples of the alloy 11 from Table I are summarized in Table II. They show that the respective gas atmosphere in conjunction with temperature control according to the invention is associated with a significant reduction of the already low catalytic coking.

Figure 5:
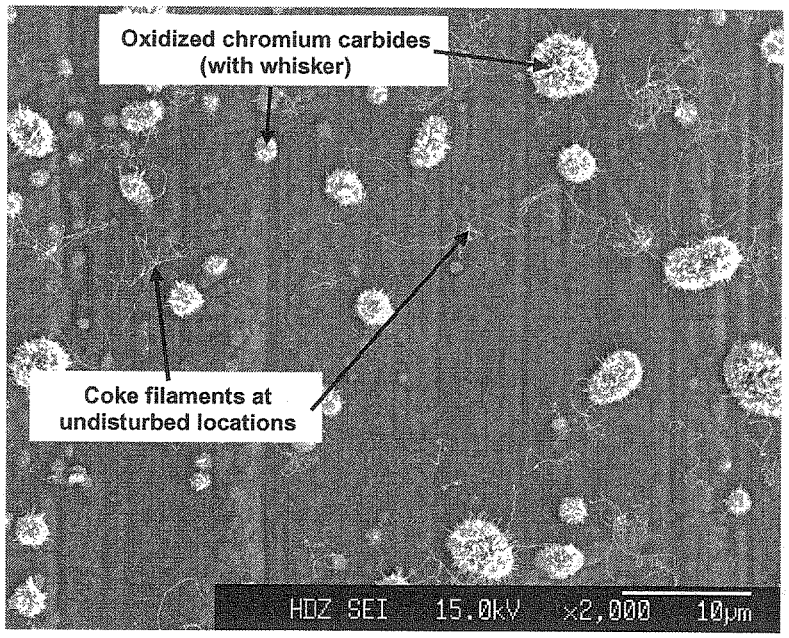
FIGS. 5 and 6 show surface micrographs with and without conditioning according to the invention.
Figure 6:
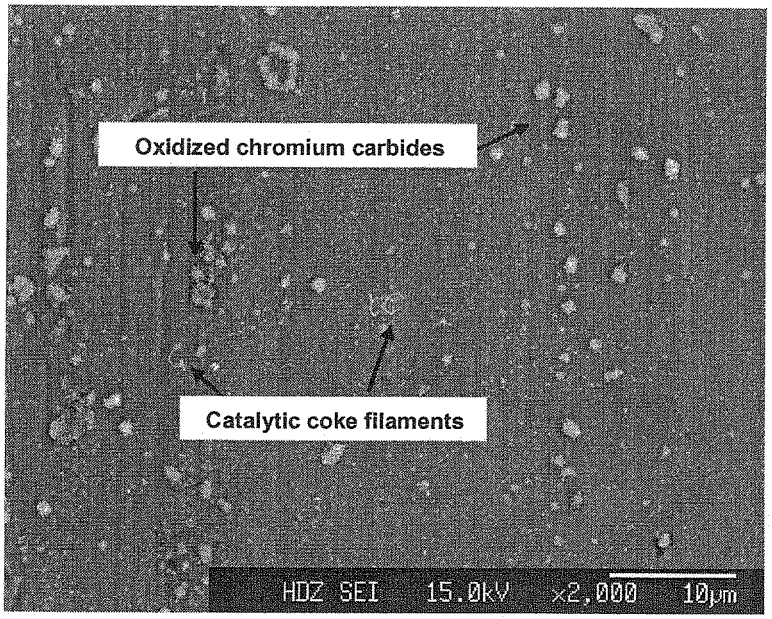

Examples of the surface properties of the tube interior of furnace tubes having the composition of the alloy 8, which is part of the invention, can be seen from FIGS. 5 and 6. FIG. 6 (Experiment 7 in Table II) shows the superiority of the surface after conditioning according to the invention compared to FIG. 5 which relates to a surface that was not conditioned according to the invention (Table II, Experiment 2).

Figure 7:
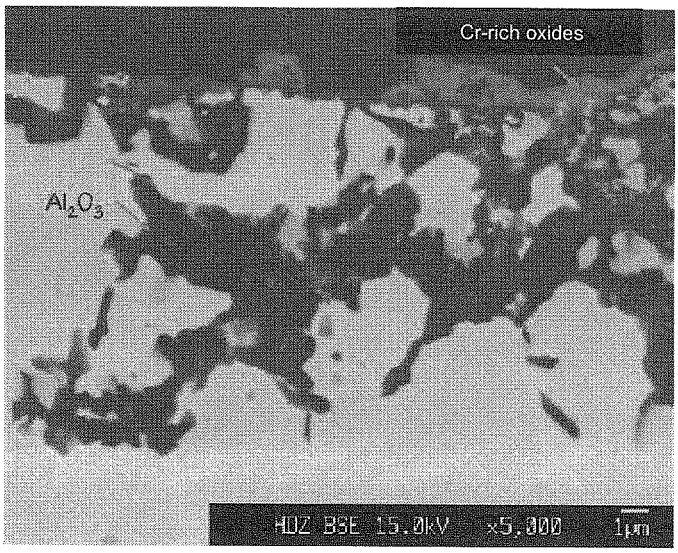
FIGS. 7 and 8 show metallographic cross-sections of surface regions.
Figure 8:
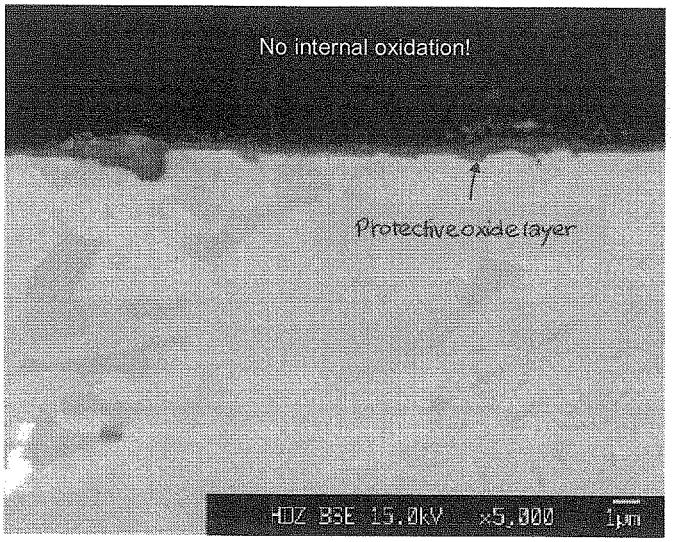

In the FIGS. 7 (alloy 14) and 8 (invention), regions near the surface are shown in a metallographic cross-section. The samples were heated to 950° C. and then subjected to 10 cracking cycles of 10 hours each in an atmosphere of water vapor, hydrogen and hydrocarbons. After each cycle, the sample tubes were burned out for one hour to remove the coke deposits. The micrograph of FIG. 7 shows in form of dark regions the large-area and hence also large-volume result of an interior oxidation on the interior tube side with a conventional nickel chromium cast alloy as compared to the micrograph of the FIG. 8 of the alloy 9 according to the invention, which virtually did not experience any interior oxidation, although both samples with subjected in an identical manner to multiple cyclical treatments of cracking, on one hand, and removal of the carbon deposits, on the other hand.

Figure 11:
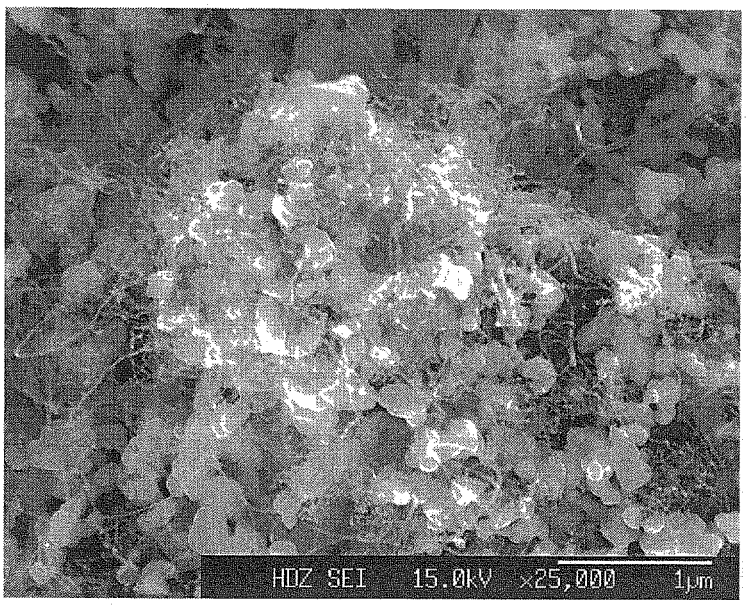
FIG. 11 shows an REM to view of the conventional sample.

The experiments show that samples from conventional alloys experience strong interior oxidation on the interior tube side, originating from surface defects. As a result, small metallic centers with a high nickel content are produced on the interior tube surface, on which a significant amount of carbon in form of carbon nanotubes is formed (FIG. 11).

Conversely, Sample 9 from an alloy according to the invention does not exhibit any nanotubes following the same 10-fold cyclical cracking and thereafter storage in a coking atmosphere, which is the result of an essentially continuous sealed, catalytically inert aluminum-containing oxide layer. Conversely, FIG. 11 shows an REM top view of the conventional sample shown in FIG. 7 in a polished section; catastrophic oxidation and therefore catastrophic generation of catalytic coke in the form of carbon nanotubes is here observed due to the missing protective layer.

Figure 9:
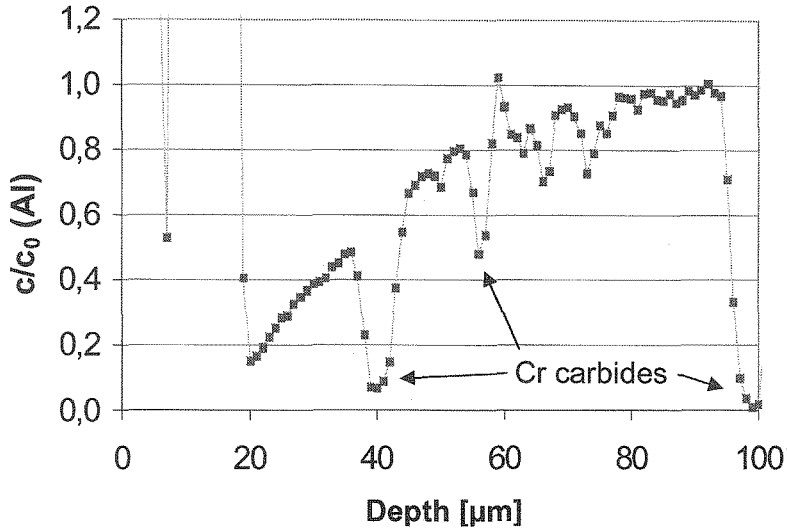
FIGS. 9 and 10 show aluminum concentration as a function of depth following various processing steps.
Figure 10:
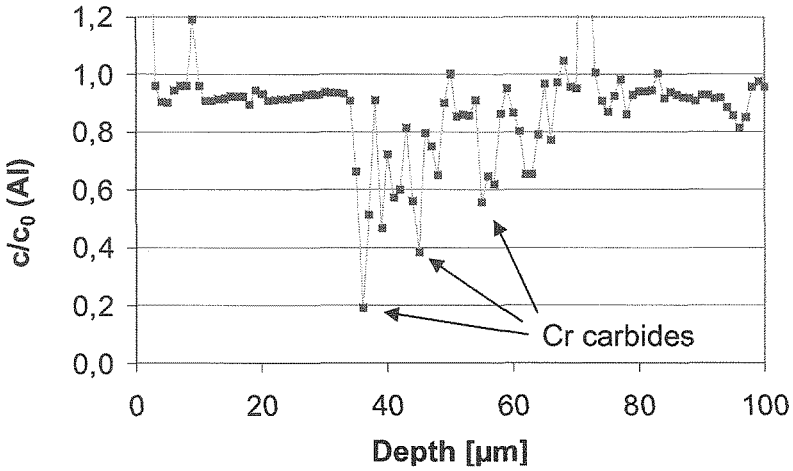

In a comparison of the diagrams of FIGS. 9 and 10, the stability of the oxide layer on an alloy according to the invention is particularly clearly demonstrated by the shape of the aluminum concentration as a function of depth of the marginal zone following ten cracking phases accompanied by an intermediate phase where the coke deposits were removed by burning out. Whereas according to the diagram of FIG. 9 the material is depleted of aluminum in the region near the surface due to the local failure of the protective cover layer and subsequently strong interior aluminum oxidation, the aluminum concentration in the diagram of FIG. 10 is still approximately at the initial level of the cast material. This shows clearly the significance of a continuous, sealed and in particular firmly adhering interior aluminum-containing oxide layer in the tubes according to the invention.

Figure 12:
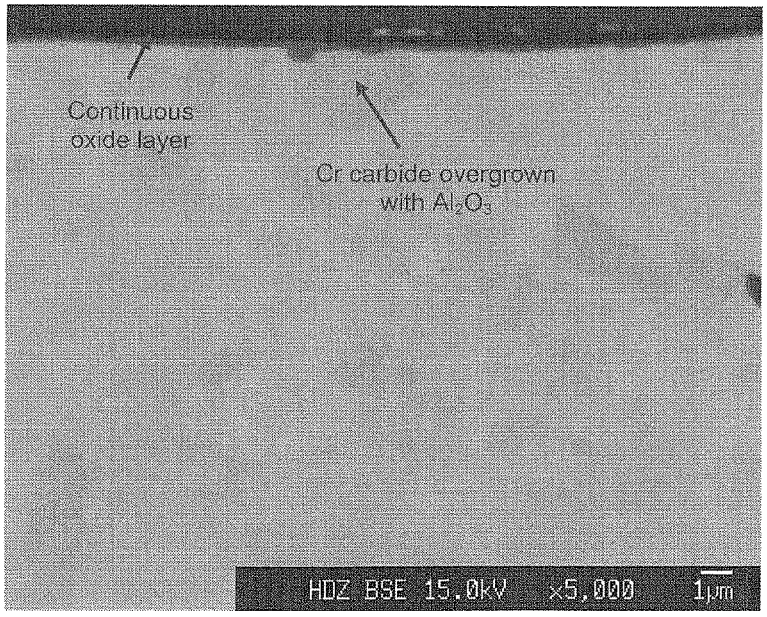
FIG. 12 shows in a metallographic cross-section a continuous aluminum-containing oxide layer after three cracking cycles.

The stability of the aluminum-containing oxide layer was also investigated in extended time tests in a laboratory system under process-like conditions. The samples of the alloys 9 and 11 according to the invention were heated in water vapor to 950° C. and then each subjected three times to 72-hour cracking at this temperature; they were then each burned out for four hours at 900° C. FIG. 12 shows the continuous aluminum-containing oxide layer after the three cracking cycles and in addition, how the aluminum-containing oxide layer covers the material even across chromium carbides in the surface. It can be seen that chromium carbides residing at the surface are completely covered by the aluminum-containing oxide layer.

Figure 13:
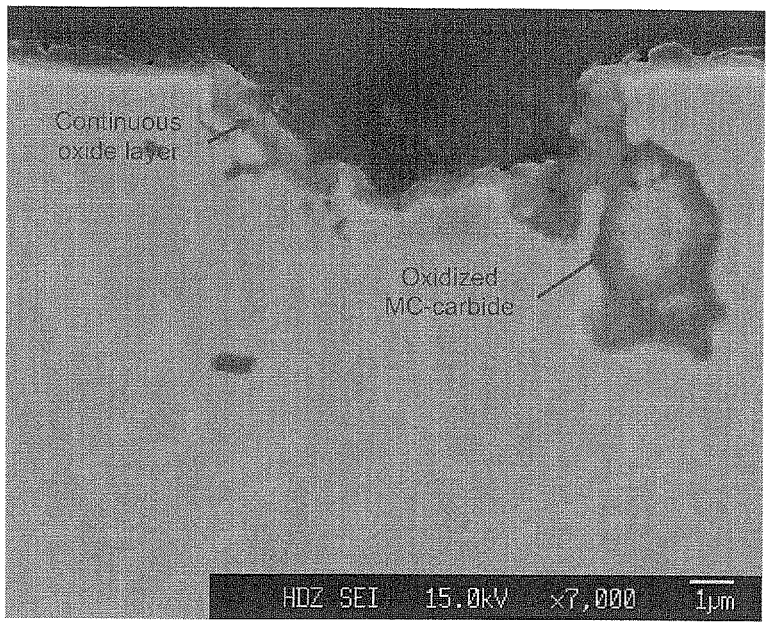
FIG. 13 shows in a metallographic cross-section a uniform aluminum-containing oxide layer protecting the material.

As clearly shown in the micrograph of FIG. 13, the material is protected by a uniform aluminum-containing oxide layer even in disturbed surface regions, where primary carbides of the basic material have accumulated and which are therefore particularly susceptible to interior oxidation. As can be seen, oxidized former MC-carbide is overgrown by aluminum-containing oxide and hence encapsulated.

Figure 14:
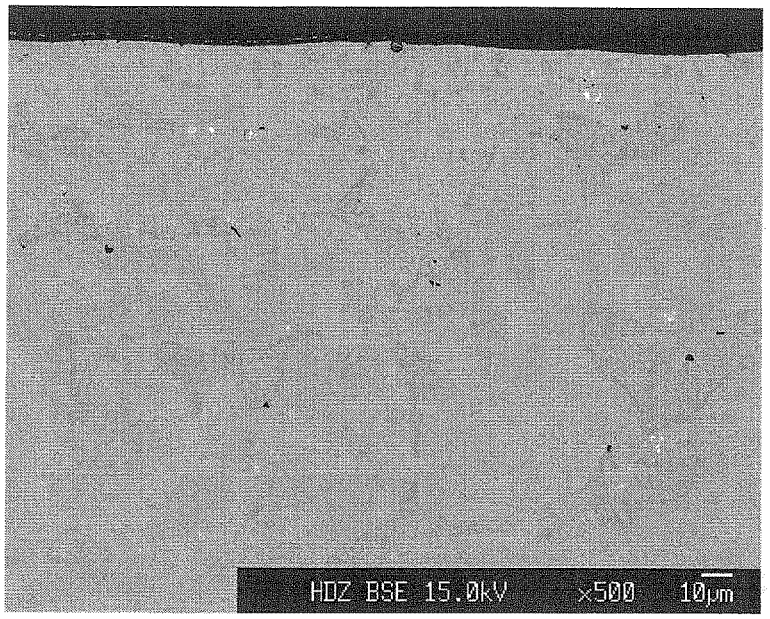
FIGS. 14 and 15 show micrographs of a near-surface zone.
Figure 15:
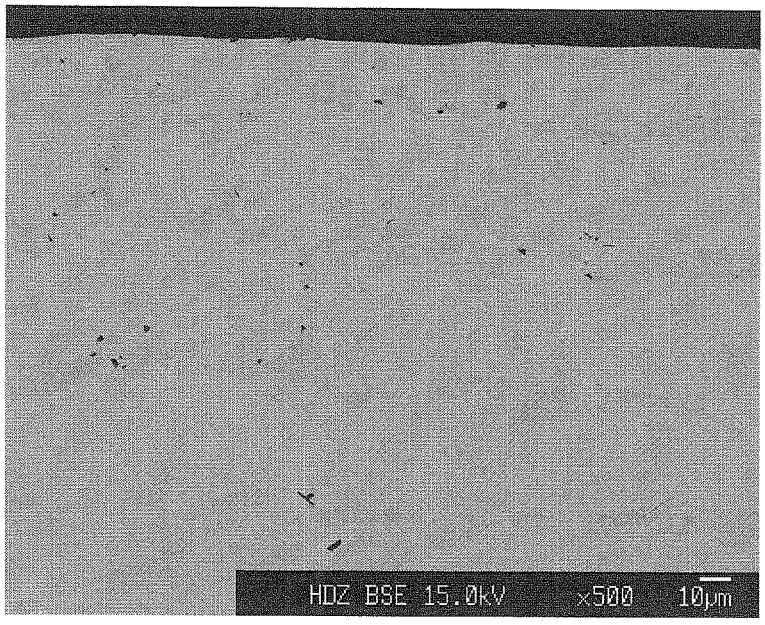

FIGS. 14 and 15 show in the micrographs of the zone near the surface that interior oxidation has not occurred even after the extended cyclic time tests, which is a result of the stable and continuous aluminum-containing oxide layer.

Samples of the alloys 8 to 11 according to the invention were used in these experiments.

Overall, the nickel chromium iron alloy according to the invention, for example as a tube material, is differentiated by a high oxidation and corrosion stability, and more particularly by a high long-term rupture strength and creep resistance, after the interior surface is removed under mechanical pressure and a subsequent multi-step in situ heat treatment for conditioning the interior surface.

In particular, the outstanding carburizing stability of the material should be mentioned, which is caused by rapid formation of a substantially closed and stable oxide layer or $Al_2O_3$-layer, respectively. This layer also substantially suppresses in steam-cracker and reformer tubes the generation of catalytically active centers accompanied by risk of catalytic coking. These material properties are still retained even after large number of significantly prolonged cracking cycles, in conjunction with burning out the deposited coke.

TABLE I (Weight %)

| Alloy | C | Si | Mn | P | S | Cr | Mo | Ni | Fe | W | Co | Nb | Al | Ti | Hf | Zr | Y | Ta | Ce |
|---|---|---|---|---|---|---|---|---|---|---|---|---|---|---|---|---|---|---|---|
| 1 | 0.44 | 0.30 | 0.02 | 0.002 | 0.003 | 29.50 | 0.20 | 46.90 | 18.20 | 0.07 | 0.40 | 0.68 | 3.05 | 0.15 | 0.15 | 0.06 | — | — | — |
| 2 | 0.44 | 0.30 | 0.02 | 0.002 | 0.003 | 29.60 | 0.15 | 46.75 | 17.90 | 0.07 | 0.30 | 0.67 | 3.18 | 0.16 | 0.60 | 0.06 | — | — | — |
| 3 | 0.49 | 0.02 | 0.01 | 0.010 | 0.004 | 30.80 | 0.01 | 51.60 | 12.50 | 0.08 | 0.01 | 0.64 | 3.58 | 0.10 | — | 0.06 | 0.004 | 0.01 | 0.005 |
| 4 | 0.42 | 0.03 | 0.03 | 0.007 | 0.005 | 26.70 | 0.02 | 46.10 | Residue | 0.07 | 0.01 | 0.69 | 2.24 | 0.08 | — | 0.05 | 0.004 | 0.01 | — |
| 5 | 0.20 | 0.01 | 0.01 | 0.010 | 0.003 | 30.40 | 0.01 | 52.30 | Residue | 0.07 | 0.01 | 0.52 | 3.17 | 0.12 | — | 0.06 | 0.004 | — | — |
| 6 | 0.38 | 0.11 | 0.01 | 0.006 | 0.003 | 29.75 | 0.05 | 44.50 | 19.70 | 0.03 | 0.05 | 0.68 | 4.25 | 0.19 | 0.20 | 0.06 | — | — | — |
| 7 | 0.48 | 0.11 | 0.01 | 0.007 | 0.003 | 30.35 | 0.05 | 44.00 | 19.40 | 0.38 | 0.05 | 0.69 | 4.05 | 0.13 | — | 0.04 | — | — | — |
| 8 | 0.47 | 0.59 | 0.13 | 0.006 | 0.002 | 29.50 | 0.07 | 42.70 | 20.72 | 0.09 | 0.06 | 0.80 | 4.54 | 0.18 | — | 0.06 | 0.24 | — | — |
| 9 | 0.44 | 0.16 | 0.09 | 0.006 | 0.002 | 30.35 | 0.07 | 42.20 | Residue | 0.03 | 0.01 | 0.78 | 3.17 | 0.1 | — | 0.07 | 0.013 | — | — |
| 10 | 0.50 | 1.43 | 0.17 | 0.006 | 0.002 | 30.10 | 0.01 | Residue | 19.20 | 0.05 | 0.05 | 0.78 | 4.00 | 0.15 | — | 0.07 | 0.18 | — | — |
| 11 | 0.42 | 0.07 | 0.09 | 0.007 | 0.003 | 30.30 | 0.02 | Residue | 21.20 | 0.04 | 0.01 | 0.77 | 3.28 | 0.23 | — | 0.11 | 0.15 | — | — |
| 12 | 0.45 | 1.85 | 1.26 | 0.007 | 0.003 | 35.02 | 0.01 | 45.70 | 14.85 | 0.01 | 0.05 | 0.81 | 0.10 | 0.20 | — | 0.05 | — | — | 0.01 |
| 13 | 0.44 | 1.72 | 1.23 | 0.010 | 0.005 | 25.02 | 0.01 | 34.40 | Residue | 0.04 | 0.01 | 0.84 | 0.13 | 0.10 | — | 0.02 | — | — | — |
| 14 | 0.45 | 0.14 | 0.06 | 0.01 | 0.003 | 25.7 | 0.02 | 57.50 | 11.40 | 0.04 | 0.01 | 0.53 | 3.90 | 0.15 | — | 0.05 | 0.04 | — | — |
| 15 | 0.44 | 0.05 | 0.19 | 0.01 | 0.002 | 30.4 | 0.07 | 55.27 | 10.71 | 0.05 | 0.09 | 0.10 | 2.40 | 0.14 | — | 0.05 | 0.024 | — | — |

TABLE II

| Test | Gas composition during heat-up phase | Temperature curve during heat-up phase | Relative coverage of surface with catalytic coke* |
|---|---|---|---|
| 1 | 100% air | From 150° C. to 875° C., | 1.4% |
| 2 | 100% water vapor | 50° C./h; 40 h hold at 875° C. | 1.1% |
| 3 | 70% water vapor 30% methane | From 150° C. to 600° C., 50° C./h; 40 h hold at | 1.2% |
| 4 | 3% water vapor 97% methane | 600° C.; from 600° C. to 875° C., 50° C./h; | 0.37% |
| 5 | 3% water vapor 97% methane (+$H_2S$-shock**) | | 0.26% |
| 6 | 3% water vapor 97% ethane (+$H_2S$-shock**) | | 0.08% |
| 7 | 3% water vapor 97% ethane | | 0.05% |

*This value was determined by counting the coke fibers on a specified tube surface.

**After reaching the operating temperature 1 h treatment with 250 ppm sulfur ($H_2S$) in water vapor.

The invention claimed is:

1. A nickel-chromium alloy, comprising:
0.4 to 0.6% carbon by weight,
28 to 33% chromium by weight,
17 to 22% iron by weight,
3 to 4.5% aluminum by weight,
0.01 to 1% silicon by weight,
0.01 to 2% manganese by weight,
0.01 to 1.0% niobium by weight,
0.001 to 0.5% titanium by weight,
0.001 to 0.3% zirconium by weight,
0.001 to 0.3% yttrium by weight, and
0.001 to 0.1% nitrogen by weight,
remainder nickel with melt-induced impurities.

2. The alloy of claim 1, wherein said alloy comprises 0.01 to 0.5% manganese by weight.

3. The alloy of claim 1, said alloy further comprising:
0.01 to 1.5% tantalum by weight, and
0.01 to 1.0% tungsten by weight.

4. The alloy of claim 1, said alloy further comprising:
0.01 to 1.0% tungsten by weight, and
0.06 to 0.11% zirconium by weight.

5. The alloy of claim 4, said alloy further comprising:
0.01 to 0.06% cobalt by weight.

* * * * *